United States Patent [19]

Knox et al.

[11] 4,191,946

[45] Mar. 4, 1980

[54] WARNING APPARATUS WITH A LINE INTEGRITY SUPERVISORY CIRCUIT

[76] Inventors: William A. Knox, 247 W. Hazelwood Ave., Rahway, N.J. 07065; Raymond J. Gonzalez, 115 Erie Ave., Rockaway, N.J. 07866

[21] Appl. No.: 843,859

[22] Filed: Oct. 20, 1977

[51] Int. Cl.[2] ..... G08B 21/00

[52] U.S. Cl. ..... 340/506; 340/652

[58] Field of Search ..... 340/409, 255, 256, 420, 340/248 C, 506, 650, 651, 652, 662

[56] References Cited

U.S. PATENT DOCUMENTS

| | | | |
|---|---|---|---|
| 2,684,475 | 7/1954 | Lode | 340/255 X |
| 3,599,206 | 8/1971 | McLeod | 340/409 |
| 3,603,973 | 9/1971 | Hough | 340/420 |
| 3,665,461 | 5/1972 | Gnägi et al. | 340/256 X |
| 3,821,734 | 6/1974 | Meier et al. | 340/409 |
| 3,978,461 | 8/1976 | DeLime | 340/409 X |

*Primary Examiner*—John W. Caldwell, Sr.
*Assistant Examiner*—Daniel Myer
*Attorney, Agent, or Firm*—Pennie & Edmonds

[57] ABSTRACT

Warning apparatus for detecting abnormal conditions, such as fire or smoke, comprises a two-conductor electrical transmission line with detectors connected across the line at spaced locations. Unfiltered rectified AC power is supplied to the input of the line, and a filter capacitor is connected across the end of the line beyond the detectors to produce a filtered DC voltage in the line. An open line, excessive line resistance, short-circuit across the line, or deterioration of the end-of-line capacitor will give rise to excessive ripple at the input end which is sensed by a supervisory circuit to indicate a trouble condition on the line. The supervisory circuit also limits maximum line current.

8 Claims, 4 Drawing Figures

WARNING APPARATUS WITH A LINE INTEGRITY SUPERVISORY CIRCUIT

The present invention relates to warning apparatus for detecting abnormal conditions at spaced locations connected by a transmission line, and including means for supervising the integrity of the transmission line. The invention is particularly designed and adapted for fire and smoke detection circuits, although it may be used in other apparatus for detecting abnormal conditions.

To protect buildings and other extensive installations, it is common to extend one or more two-conductor electrical transmission lines from a control panel at a desired location through the building or other installation to be protected, and connect detectors across the line at various locations. DC power is supplied to the line at the central panel to energize the detectors along the line. Alarm means responsive to the detectors is provided, frequently at the control panel.

It is important to supervise the line integrity, particularly for an open circuit condition which would render one or more of the detectors inoperative. This has previously been done by connecting a resistance across the end of the line, which draws more current than the detectors under normal conditions, and monitoring the current. Since the monitoring current flows continuously, considerable energy may be used over a period of time even though an alarm condition does not arise. Frequently more than one line is connected to the same power supply to provide multiple zone protection. Thus, more supervisory current is required. Further, it is common to provide a stand-by battery for emergency use in case of power mains failure, and such a battery must be of adequate size to supply the monitoring current for the duration of the emergency or for a predetermined period of time.

The present invention is directed to the provision of a warning system including a supervisory circuit in which the current required for supervision is materially reduced, while adding little if any cost to the system.

In accordance with the invention, power is supplied to one end of the line from an unfiltered rectified AC source. A filter capacitance is connected across the other end of the line, beyond the detectors. Normally the capacitance provides sufficient filtering to produce a DC voltage of low ripple amplitude on the line. However, if the line becomes open, the effect of the capacitance is lost and a high ripple voltage appears at the input end of the line. Supervisory means is provided which is responsive to ripple voltages at the input end of the line, above a predetermined amplitude greater than the normal ripple amplitude and indicates a trouble condition on the line.

Although it is particularly important to indicate an open circuit condition, the supervisory circuit can also respond to an excessively high series resistance of the line, an excessively low shunt resistance, or deterioration of the end-of-line capacitance.

With the end-of-line capacitance, little line current is required for supervision under normal conditions, since only charging current for the capacitance need be supplied in addition to the current drawn by the detectors. Also, when a stand-by battery is used during interruptions in the AC mains supply, no current is drawn by the capacitance. Thus, economical operation under normal conditions is promoted. Although some current may be drawn by the ripple sensing circuit, this can be kept much lower than the supervisory current drawn by an end-of-line resistance.

Inasmuch as a filter capacitance is normally employed in conventional DC power supplies, and is eliminated in the apparatus of the invention, the use of an end-of-line capacitance adds little if any cost while reducing normal system power requirements.

Other features and advantages of the invention will be apparent from the following description of a specific embodiment thereof.

Figure 1:
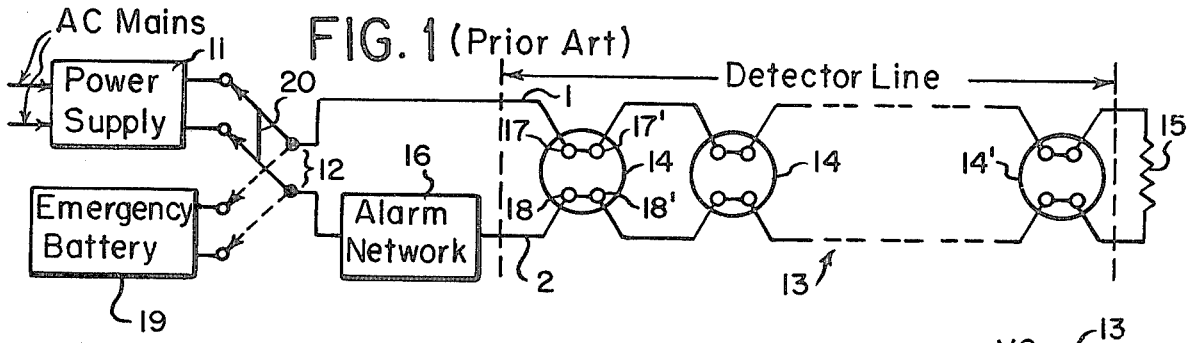
FIG. 1 (Prior Art)
FIG. 1 illustrates a conventional prior art arrangement employing an end-of-line resistance.

Referring to FIG. 1, a DC power supply 11 normally supplies power to the input terminals 12 of a transmission line generally indicated as 13. A plurality of detectors 14 are connected across the line at spaced points therealong. The length of the line varies with the particular installation, but typically may be one-half mile to a mile long. An end-of-line resistor 15 is connected across the line at the far end beyond the last detector 14'. An alarm network 16 is responsive to current in the line, and has threshold levels to distinguish between a trouble condition on the line, and an alarm condition when one or more detectors respond to an abnormal condition such as fire or smoke.

Commonly the detectors are plug-in units with three or four contact points internally connected so that the transmission line conductors are completed through the plug-in unit. Thus, if a detector is removed, or a contact is dislodged, the line will open and yield a trouble indication. As shown, upper contacts 17,17' complete the circuit of line conductor 1, and the lower contacts 18,18' complete the circuit of line conductor 2. Lower contacts 18,18' may be combined so that the plug has only three contacts, since internally connected contacts 17,17' may suffice.

In case of failure of the AC mains supply to 11, an emergency battery 19 may be switched into use by switch 20.

For fire and smoke detection, detectors 14 may be of the ionization type normally drawing about 0.1 ma per detector. Typically up to 30 detectors may be connected across the line, drawing up to 3 ma under normal conditions. The DC line voltage may be about 22 volts. When first or smoke is detected by one of detectors 14, it may draw 50 ma or more. Accordingly, resistance 15 is selected to draw a current greater than the maximum normal current of the plurality of detectors, and less than the current of one detector when actuated by fire or smoke, say 12–15 ma. The trouble threshold of alarm network 16 is typically 6–8 ma and the alarm threshold 25–35 ma.

As is apparent, the supervisory current is several times the normal operating current, and may be much greater if further lines are connected to the same power supply.

Figure 2:
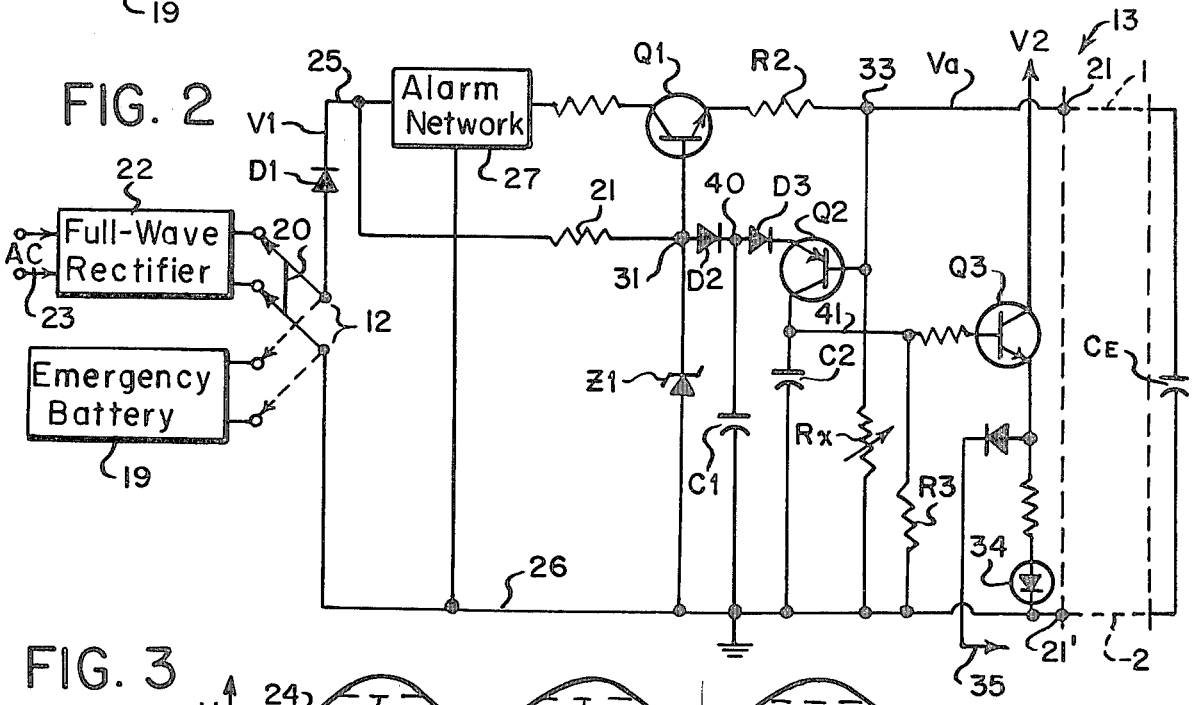
FIG. 2 illustrates an arrangement in accordance with the invention.

Referring to FIG. 2, a control and supervisory unit is shown having input terminals 12 and output terminals 21,21' which are connected to conductors 1 and 2 of the transmission line 13 across which the detectors are connected as shown in FIG. 1.

Figure 3:
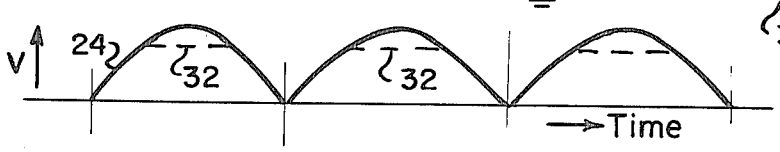
FIG. 3 illustrates an unfiltered full-wave rectified AC voltage.

A full-wave rectifier 22 is energized from the AC mains 23 and yields an output voltage V1 as shown at 24 in FIG. 3. The voltage wave is applied to line 25 through diode D1, which protects against reverse polarity. Line 26 may be grounded. Inserted in line 25 is an alarm network 27 and a series voltage regulator including transistor Q1 and series resistor R2.

Line 25 is also connected through resistor R1 to the base-emitter circuit of Q1 to control current therethrough. Zener diode Z1 limits the control voltage to Q1 to a desired value, say 22 volts at point 31. This is indicated by the dash line 32 in FIG. 3. Point 31 is connected through diodes D2, D3 and the emitter-base circuit of Q2 to point 33. The base of Q2 is connected through an adjustable resistor Rx to ground. The collector is connected through R3 to ground, and R3 is shunted by capacitor C2. Capacitor C1 is connected from the common point of D2 and D3 to ground.

Q2, R3 and C2 form a detector circuit for ripple voltages at 33 above a predetermined amplitude. Q2 conducts when the ripple at 33 exceeds a threshold level set by Rx, as described more fully below. Q3 is connected as an emitter follower and, when Q2 conducts, Q3 also conducts to turn on diode 34. Diode 34 is a light emitting diode and informs the operator that there is trouble on the line. An output from Q3 is also supplied to line 35, which can be connected to warning or other apparatus at the same or different location to indicate that trouble exists. The collector of Q3 is connected to voltage source V2.

Considering normal operation, with the maximum voltage at point 31 and the base of Q1 limited by Z1, the voltage Va at point 33 will be less due to the base-emitter drop in Q1, which is about 0.6 volts for a silicon transistor, and the drop across R2 which will be small for a low resistance value. With the transmission line intact, $C_E$ will charge up to Va and maintain Va at a substantially constant DC value indicated at 36 in FIG. 4. A small ripple may exist as indicated at 37.

Bias for Q2 is provided by the circuit including D2, D3 and the emitter-base circuit of Q2, connected across the base-emitter circuit of Q1 and series resistor R2. In this path there are three diode drops, giving a total of about 1.8 volts for silicon components. Thus, Q2 will normally be biased to its off (non-conductive) condition.

Figure 4:
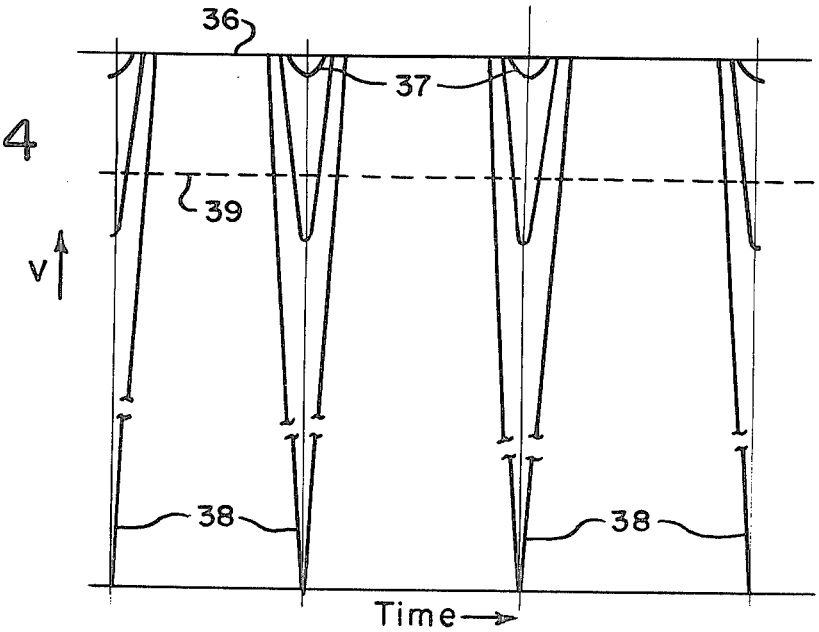
FIG. 4 illustrates ripple conditions which may occur at the input end of the transmission line.

If, now, one or both of conductors 1,2 of the transmission line should open, the filtering or smoothing effect of $C_E$ will be lost, and a large ripple will exist at point 33 such as illustrated at 38 in FIG. 4. The ripple peaks extend downward from line 36, which is held constant by the voltage regulator. Capacitor C1 holds the voltage at point 40 substantially constant and equal to the peak voltage 32 at point 31 less the diode drop in D1. Consequently, the base of Q2 will intermittently go sufficiently negative to point 40 to turn Q2 on and produce a voltage across R3 which is stored by C2 and actuates the trouble circuit of Q3.

Troubles other than an open-circuit may exist on the transmission line which should be corrected, and these may be detected and indicated. Thus, there may be an increase in line resistance due to injury to the line, poor contacts at the plug-in units, etc. Or, leakage paths may form between the conductors due to insulation damage, etc. These will reduce the effectiveness of the end-of-line capacitor $C_E$, and increase the ripple at point 33. Also, if $C_E$ deteriorates, the ripple will increase and the deterioration may be detected. This is an additional advantage since in conventional circuits deterioration of a filter capacitor may go undetected and the power supply may not be capable of supplying sufficient current under alarm conditions.

The threshold of the ripple detector may be adjusted by Rx to respond to the desired ripple level, such as shown at 39 in FIG. 4.

When a trouble condition has been corrected, the supervisory circuit automatically restores itself to normal operation.

The circuit of FIG. 2 also serves to limit the maximum current that can flow to the line. This prevents damage to the power supply and avoids the need and expense of excessively large components, as well as avoiding the need for an excessively large stand-by battery. As current increases, the voltage drop across R2 increases until the voltage difference from point 31 to 33 equals the contact voltage drops through D2, D3 and the emitter-base of Q2, whereupon the voltage difference becomes constant and limits the current through Q1. In one embodiment the current was limited to about 200 ma.

In one embodiment which has been operated successfully, R1 was 1K, R2 was 7.5 ohms, Rx had a nominal setting in the range of 15K, and R3 was 56K. Capacitors C1 and C2 were 6.8 mfd. and the end-of-line capacitor $C_E$ was 50 mfd. These values are given for illustration only, and not by way of limitation. Different applications may require markedly different component values.

We claim:

1. Warning apparatus for detecting abnormal conditions at spaced locations which comprises
   (a) a two-conductor electrical transmission line,
   (b) a source of substantially unfiltered rectified AC power for connection to one end of said line,
   (c) a plurality of detectors connected across said line at spaced locations from said one end and adapted to respond to abnormal conditions at the respective locations,
   (d) filter capacitance connected across said line at the end thereof beyond said detectors with respect to said one end for producing a DC voltage of low ripple amplitude on said line,
   (e) alarm means responsive to said detectors, and
   (f) supervisory means responsive to ripple voltages at said one end of the line above a predetermined amplitude greater than said low ripple amplitude for indicating a trouble condition on said line.

2. Apparatus according to claim 1 including voltage regulator means connected between said source and said one end of the line.

3. Apparatus according to claim 2 in which said voltage regulator means is a series voltage regulator including a regulator transistor and a series resistance, the regulator transistor having a base-emitter control circuit, means including a Zener diode for applying said rectified voltage to the base-emitter control circuit of the regulator transistor and limiting the maximum value of the applied voltage, said supervisory means including a transistor detector circuit connected across said one end of the line, the detector transistor having a base-emitter control circuit, and biasing means for the detector transistor for producing a threshold level for detecting ripple voltages above said predetermined amplitude, said biasing means including diode means and the base-emitter circuit of the detector transistor connected across the base-emitter circuit of the regulator transistor and said series resistance.

4. Apparatus according to claim 3 including indicator means connected to said transistor detector circuit for providing an indication of ripple voltages exceeding said predetermined level.

5. Apparatus according to claim 1 including a battery supply and means for connecting the battery supply to said one end of the line in place of said source.

6. Apparatus for detecting abnormal conditions at spaced locations which comprises (a) a two-conductor electrical transmission line, (b) a plurality of DC actuated detectors connected across said line at spaced locations therealong, (c) the current drawn by said detectors being normally low and rising to substantially higher values in response to an abnormal condition sensed thereby, (d) a power supply for connection to the input end of said line and adapted to supply substantially unfiltered full-wave rectified AC power to said input end, (e) a battery supply for connection to the input end of said line in place of said power supply, (f) voltage regulator means connected between said power supply and said input end of the line, (g) a filter capacitor connected across said line at the end thereof beyond said detectors with respect to said input end, (h) said filter capacitor and voltage regulator means normally maintaining a DC voltage on said line having a low ripple amplitude, (i) alarm means responsive to current in said line above a predetermined value for indicating actuation of one or more detectors, and (j) supervisory means responsive to ripple voltages at the input end of said line above a predetermined amplitude greater than said low ripple amplitude for indicating a trouble condition on said line.

7. Apparatus according to claim 6 in which said voltage regulator means is a series voltage regulator including a regulator transistor and a series resistance, the regulator transistor having a base-emitter control circuit, means including a Zener diode for applying said rectified voltage to the base-emitter control circuit of the regulator transistor and limiting the maximum value of the applied voltage, said supervisory means including a transistor detector circuit connected across said one end of the line, the detector transistor having a base-emitter control circuit, and biasing means for the detector transistor for producing a threshold level for detecting ripple voltages above said predetermined amplitude, said biasing means including diode means and the base-emitter circuit of the detector transistor connected across the base-emitter circuit of the regulator transistor and said series resistance.

8. Apparatus according to claim 7 including indicator means connected to said transistor detector circuit for providing an indication of ripple voltages exceeding said predetermined level.

* * * * *